US009180349B1

(12) United States Patent
Seluga et al.

(10) Patent No.: US 9,180,349 B1
(45) **Date of Patent: *Nov. 10, 2015**

(54) GOLF CLUB HEAD WITH ADJUSTABLE CENTER OF GRAVITY

(71) Applicant: CALLAWAY GOLF COMPANY, Carlsbad, CA (US)

(72) Inventors: James A. Seluga, Carlsbad, CA (US); Wee Joung Kim, Vista, CA (US); Scott R. Manwaring, Carlsbad, CA (US); Denver Holt, Carlsbad, CA (US)

(73) Assignee: CALLAWAY GOLF COMPANY, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/173,615

(22) Filed: Feb. 5, 2014

Related U.S. Application Data

(63) Continuation-in-part of application No. 14/039,102, filed on Sep. 27, 2013, now Pat. No. 8,834,294, which is a continuation of application No. 13/797,404, filed on Mar. 12, 2013.

(60) Provisional application No. 61/657,247, filed on Jun. 8, 2012, provisional application No. 61/684,079, filed on Aug. 16, 2012, provisional application No. 61/898,956, filed on Nov. 1, 2013, provisional application No. 61/665,203, filed on Jun. 27, 2012.

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0433* (2013.01); *A63B 2053/0491* (2013.01); *A63B 2053/0495* (2013.01)

(58) Field of Classification Search
CPC ..... A63B 53/06; A63B 53/0466; A63B 2053/0491; A63B 2053/0495; A63B 2053/0433
See application file for complete search history.

(56) References Cited

U.S. PATENT DOCUMENTS

| | | | | | |
|---|---|---|---|---|---|
| 1,133,129 | A * | 3/1915 | Govan | 473/337 |
| 3,652,094 | A * | 3/1972 | Glover | 473/337 |
| 5,447,309 | A * | 9/1995 | Vincent | 473/345 |
| 5,941,782 | A * | 8/1999 | Cook | 473/346 |
| 7,997,998 | B2 * | 8/2011 | Bennett et al. | 473/328 |
| 8,192,303 | B2 * | 6/2012 | Ban | 473/335 |

(Continued)

FOREIGN PATENT DOCUMENTS

| | | | |
|---|---|---|---|
| GB | 303290 | | 1/1929 |
| JP | 2006-320493 | * | 11/2006 |
| JP | 2011125623 A | * | 6/2011 |

*Primary Examiner* — Stephen Blau
(74) *Attorney, Agent, or Firm* — Rebecca Hanovice; Michael A. Catania; Sonia Lari

(57) ABSTRACT

A golf club head comprising a plurality of center of gravity adjustment assemblies is disclosed herein. In some embodiments, the golf club head comprises a plurality of weight ports and a vertical center of gravity adjustment assembly. In other embodiments, the golf club head comprises two vertical center of gravity adjustment assemblies and one horizontal center of gravity adjustment assembly that allows weight to be shifted in a direction perpendicular to a face of the golf club head. In some embodiments, the horizontal center of gravity adjustment assembly may include a slidable weight, while in others it may include a flippable weight cartridge.

8 Claims, 4 Drawing Sheets

(56) References Cited

U.S. PATENT DOCUMENTS

| | | | | |
|---|---|---|---|---|
| 8,206,243 | B2 * | 6/2012 | Stites | 473/334 |
| 8,376,878 | B2 * | 2/2013 | Bennett et al. | 473/334 |
| 8,591,352 | B2 * | 11/2013 | Hirano | 473/336 |
| 2002/0137576 | A1 | 9/2002 | Dammen | |
| 2010/0075773 | A1 * | 3/2010 | Casati, Jr. | 473/334 |
| 2010/0144461 | A1 * | 6/2010 | Ban | 473/338 |
| 2010/0292027 | A1 * | 11/2010 | Beach et al. | 473/334 |
| 2011/0152000 | A1 * | 6/2011 | Sargent et al. | 473/334 |
| 2011/0152001 | A1 * | 6/2011 | Hirano | 473/337 |
| 2011/0224017 | A1 * | 9/2011 | Thomas et al. | 473/332 |
| 2013/0109501 | A1 * | 5/2013 | Stites et al. | 473/335 |
| 2014/0080628 | A1 * | 3/2014 | Sargent et al. | 473/336 |
| 2014/0080629 | A1 * | 3/2014 | Sargent et al. | 473/336 |

* cited by examiner

GOLF CLUB HEAD WITH ADJUSTABLE CENTER OF GRAVITY

CROSS REFERENCES TO RELATED APPLICATIONS

The present application claims priority to U.S. Provisional Patent Application No. 61/898,956, filed on November 1, 2013, and is a continuation in part of U.S. patent application Ser. No. 14/039,102, filed on September 27, 2013, which is a continuation of U.S. patent application Ser. No. 13/797,404, filed on March 12, 2013, which claims priority to 61/657,247, filed on June 8, 2012, and to 61/684,079, filed on August 16, 2012, and to 61/665,203, filed on June 27, 2012, the disclosure of each of which is hereby incorporated by reference in its entirety herein.

BACKGROUND OF THE INVENTION

1. Field of the Invention

The present invention relates to a golf club head. More specifically, the present invention relates to a golf club head with adjustable center of gravity location.

2. Description of the Related Art

The prior art discloses various designs with center of gravity adjustments to improve golf club performance, but fails to provide a golf club with designs that efficiently alter center of gravity parameters and consequentially enable the golf club to be swung faster along its path and contribute to an improved impact event with the golf ball.

The United States Golf Association (USGA) has increasingly limited the performance innovations of golf clubs, particularly drivers, Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a golf club head design wherein the location, and particularly the height, of the center of gravity is adjustable.

BRIEF SUMMARY OF THE INVENTION

The main objective of the present invention is to improve the location, and particularly the height, of the center of gravity. To improve the height of the center of gravity, a golf club head is created which has center of gravity height adjustment assembly. This multiple designs enabling adjustment of the center of gravity can affect the moment of inertia and ultimately the forgiveness of the golf club head.

Another object of the present invention is an adjustable weighting feature for vertical center of gravity control which is placed to maximize effectiveness and may be entirely concealed from view at address.

One aspect of the present invention is a golf club head comprising a face component and a body comprising a crown, a sole, a heel side, a toe side, and a rear side, at least one center of gravity adjustment assembly comprising a tube extending through an interior cavity of the golf club head and a cylindrical weight cartridge sized to fit within the tube, and a slidable weight assembly comprising a pair of parallel rails and at least one slidable weight sized to fit over the pair of parallel rails. In some embodiments, the golf club head further comprises at least one weight port, which may he disposed in the sole, and the at least one center of gravity adjustment assembly may be disposed within the body and may extend from the sole to the crown. In some embodiments, the slidable weight assembly may be disposed on the sole and may extend perpendicular to the face component.

In another embodiment, the at least one weight port may comprise first, second and third weight ports, and wherein each of the first, second, and third weight ports may be disposed in the sole. In some further embodiments, the first weight port may be disposed proximate the heel side, the second weight port may be disposed proximate the toe side, and the third weight port may be disposed proximate the rear side. In a further embodiment, the golf club head may further comprise first, second, third, and fourth caps, each of which may be sized to fit within the first, second, and third weight ports, and the center of gravity adjustment assembly may comprise an opening sized to receive any of the caps. In one further embodiment, each of the caps may comprise a mass of no less than 1 gram and no more than 10 grams.

In another embodiment, the golf club head may have a mass of 200 to 210 grams. In some embodiments, the at least one center of gravity adjustment assembly may comprise first, second, and third center of gravity adjustment assemblies. In a further embodiment, the first center of gravity adjustment assembly may be disposed within the body proximate the heel side and extends from the sole to the crown and the second center of gravity adjustment assembly may be disposed within the body proximate the toe side and extends from the sole to the crown. In another embodiment, the third center of gravity adjustment assembly may extend perpendicular to the face component. In a further embodiment, the golf club head may comprise first, second, and third removable weight cartridges, each center of gravity adjustment assembly may comprise a tube, and each removable weight cartridge may be sized to fit within each of the first, second, and third center of gravity adjustment assemblies. In some embodiments, each removable weight cartridge may have a mass of 5 to 12 grams.

In another embodiment, the golf club head may comprise an adjustable hosel. In some embodiments, the at least one center of gravity adjustment assembly or the slidable weight assembly may adjust a bias of the golf club head by at least 0.100 inch. In another embodiment, the slidable weight assembly may adjust a center of gravity depth by at least 0.080 inch and a center of gravity height by at least 0.090 inch. In another embodiment, the at least one slidable weight may comprise a mass of 2 to 10 grams.

In yet another embodiment, the golf club head may be selected from the group consisting of a wood-type head, an iron-type head, a hybrid-type head, and a putter-type head, and in a further embodiment, may be a wood-type head such as a driver.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

The design approaches described herein are based on the construction used in Callaway Golf Company's RAZR Fit driver head, characterized by a composite crown adhesively bonded to a cast Titanium body, which comprises a face and a sole, and may also comprise a ribbon or skirt portion. However, the embodiments disclosed herein may be used with other golf club head constructions, including but not limited to all Titanium, all composite and composite body with metal face cup.

Figure 1:
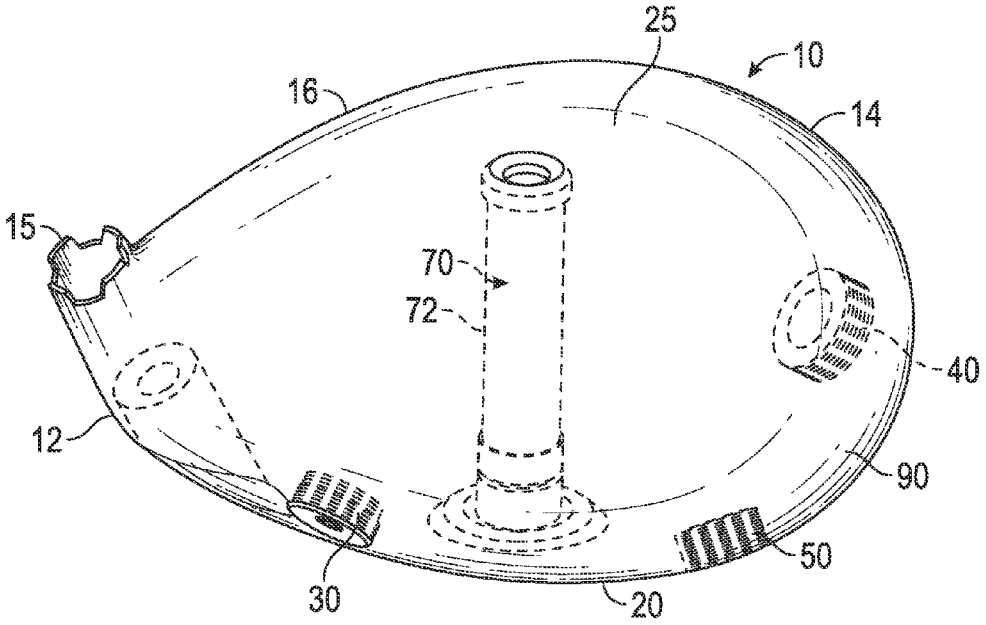
FIG. 1 is a rear perspective, transparen view of a first embodiment of the golf club head of the present invention.
Figure 2:
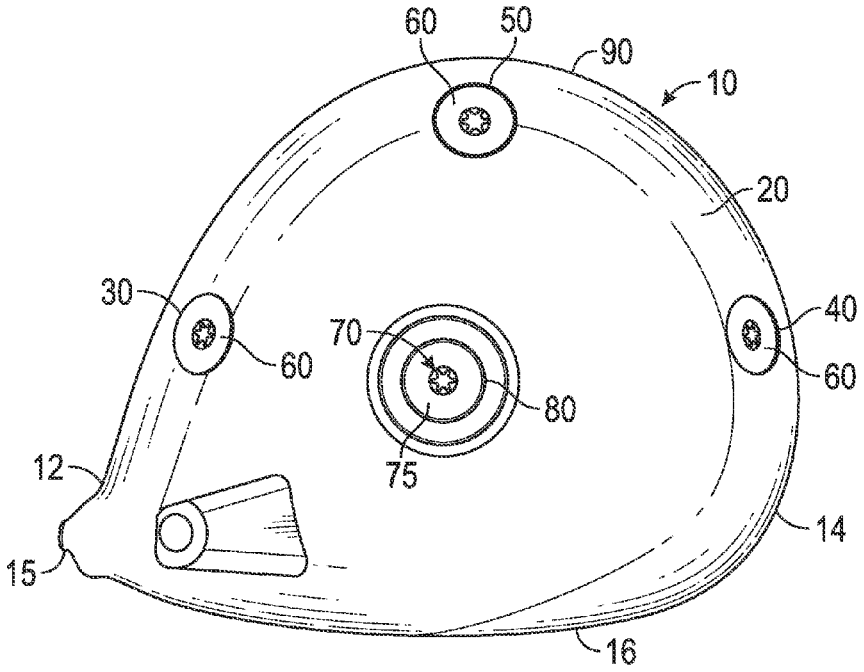
FIG. 2 is a sole plan view of the embodiment shown in FIG. 1.
Figure 7:
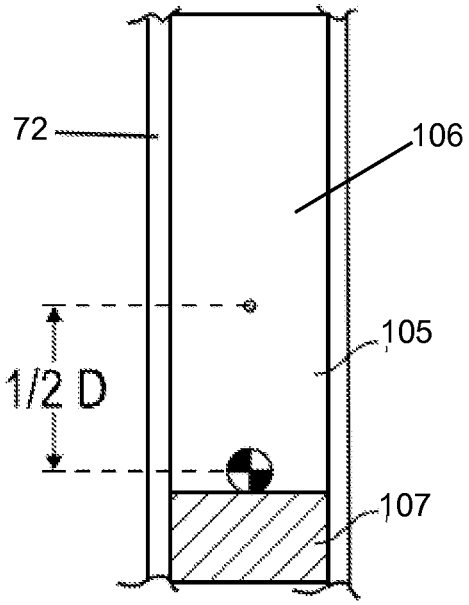
FIG. 7 is a perspective view of a center of gravity height adjustment assembly comprising a tube and a cartridge, wherein the distance from the midpoint of the cartridge to the center of gravity of the cartridge is shown.

In a first, preferred embodiment of the present invention shown in FIGS. 1 and 2, the golf club head 10 includes a sole 20 with a first, heel-side weight port 30, a second, toe-side weight port 40, and a rear weight port 50 disposed proximate a rear side 90 of the golf club head 10, all of which preferably have a circular shape and are sized to receive circular weights 60. The golf club head, which has an adjustable hosel 15, also includes a center of gravity height adjustment assembly 70, which preferably is selected from the assemblies disclosed in U.S. patent application Nos. 13/797,404 and 14/039,102, the disclosure of each of which is hereby incorporated by reference in its entirety herein. Most preferably, the center of gravity height adjustment assembly 70 includes a tube 72 that extends from the sole 20 to the crown 25 within the golf club head 10. The center of gravity height adjustment assembly 70 also includes a cartridge 105, which comprises a polymer 106 and a slug 107 composed of a material having a specific gravity greater than that of the polymer 106, as shown in FIG. 7.

The preferred design for a golf club head 10 incorporating a center of gravity height adjustment assembly 70 comprising a tube 72 and a cartridge 105 can be determined using the equation $D \geq 0.065(1+M/M_T)$, wherein M is the mass of the golf club head 10, L is the length of the cartridge 105 and $M_T$ is the mass of the cartridge 105, the distance from the midpoint of the length L to a center of gravity of the cartridge 105 when the cartridge 105 is disposed within the tube 72 such that the slug 107 is closer to the sole 20 may be defined as ½D, and D is the total center of gravity distance change for the cartridge 105 when its orientation is changed within the tube 72 by being flipped.

Each of the circular weights 60 preferably has the same construction as the cap 75 used to close off the sole opening 80 to the center of gravity height adjustment assembly 70, and each may have a mass ranging from 1 to 10 grams. More preferably, two weights 60 have a mass of 1.5 grams, one weight 60 has a mass of 7.5 grams, and the last weight 60 has a mass of 8 grams. This golf club head 10, which allows for the adjustment of bias, CG depth (distance from the golf club face towards a rear side of the golf club head), and CG height, may have the characteristics shown in Table 1 below.

TABLE 1

| Current | Estimate | CG Delta | | |
|---|---|---|---|---|
| Mass (g) | Mass (g) | Depth | Bias | Height |
| 205 | 202.5 | 0.059 | 0.104 | 0.084 |

Figure 3:
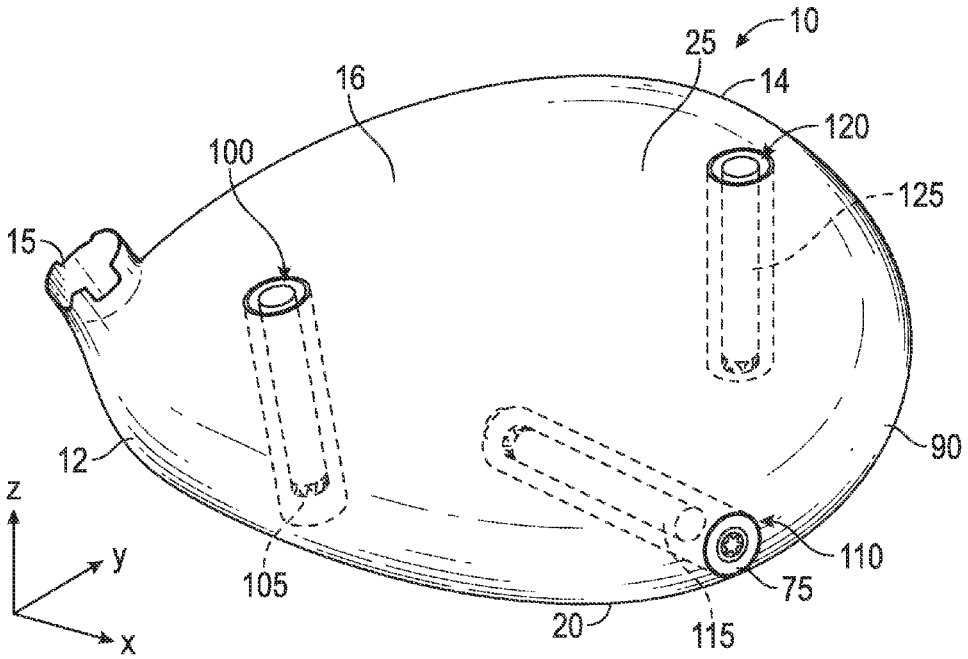
FIG. 3 is a rear perspective, transparent view of a second embodiment of the golf club head of the present invention.

In a second embodiment, shown in FIG. 3, the golf club head 10 comprises an adjustable hosel 15 and three center of gravity adjustment assemblies 100, 110, 120, two of which are disposed vertically and are parallel to golf club head 10 Z-axis, and one of which is disposed horizontally along the golf club head 10 X-axis. The first center of gravity adjustment assembly 100 is located proximate the heel side 12 of the golf club head 10, the second center of gravity adjustment assembly 120 is located proximate the toe side 14 of the golf club head 10, and both of these assemblies 100, 120 extend from the sole 20 to the crown 25 proximate the face 16. The cartridges 105, 125 retained within these assemblies 100, 120 may be accessible via the crown 25 and/or the sole 20, preferably have masses of 12 grams and 5 grams, and allow for the creation of four different center of gravity height positions within the golf club head 10, The golf club head 10 bias can also be adjusted by swapping the cartridges 105, 125 between the first and second assemblies 100, 120.

The third center of gravity adjustment assembly 110 allows the depth of the center of gravity along the X-axis (away from the face towards the rear side of the golf club head) to be adjusted, and the cartridge 115 disposed within this assembly 110 preferably has a mass of 7 grams. In some embodiments, all of the cartridges 105, 115, 125 are interchangeable between the center of gravity adjustment assemblies 100, 110, 120, while in other embodiments, the third cartridge 115 cannot be swapped with the other two cartridges 105, 125. This golf club head 10, which allows for the adjustment of bias, CG depth, and CG height, may have the characteristics shown in Table 2 below.

TABLE 2

| Current | Estimate | CC Delta | | |
|---|---|---|---|---|
| Mass (g) | Mass (g) | Depth | Bias | Height |
| 210 | 204.3 | 0.081 | 0.102 | 0.090 |

Figure 4:
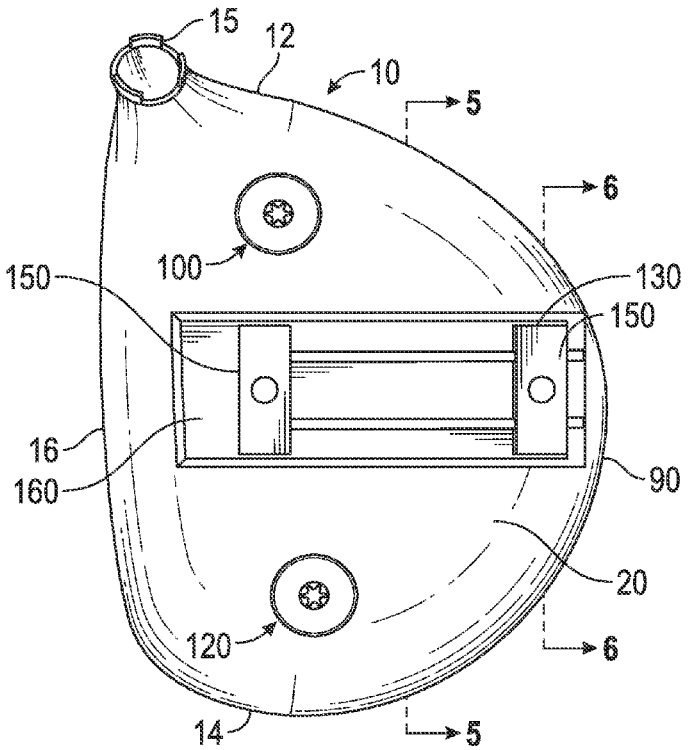
FIG. 4 is a sole plan view of a third embodiment of the golf club head of the present invention.
Figure 5:
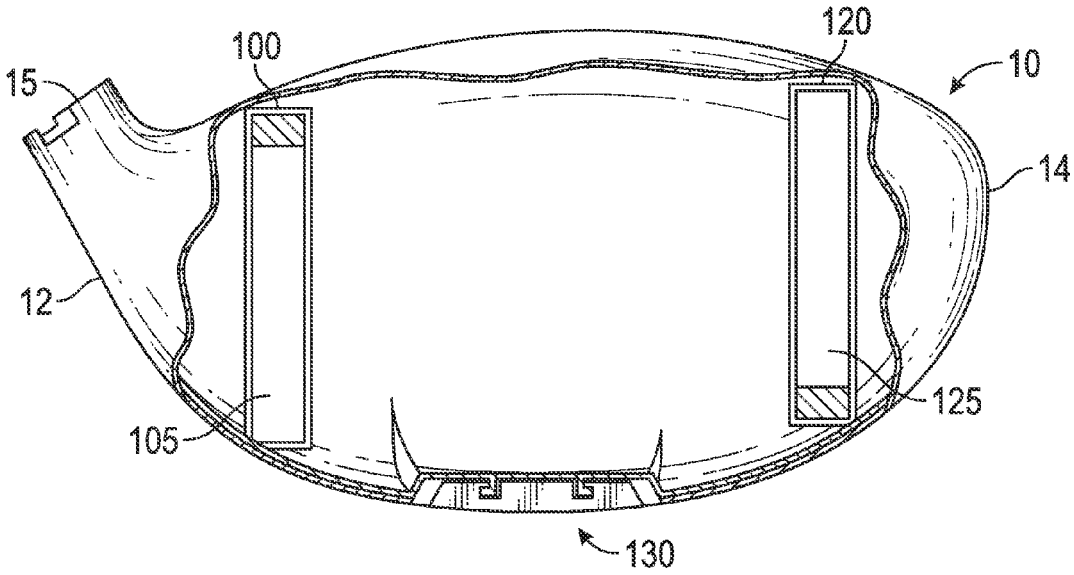
FIG. 5 is a cross-sectional view of the embodiment shown in FIG. 4 along lines 5-5.
Figure 6:
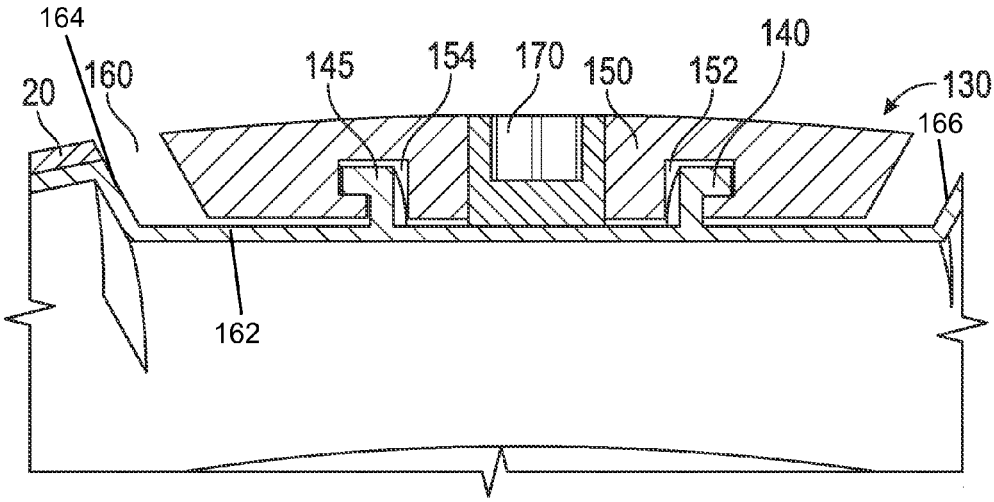
FIG. 6 is a cross-sectional view of the embodiment shown in FIG. 4 along lines 6-6.

In a third embodiment, shown in FIGS. 4-6, the golf club head is identical to the second embodiment except that it includes a slidable weight assembly 130 instead of the third center of gravity assembly 110 shown in FIG. 3. The slidable weight assembly 130 preferably includes a pair of parallel rails 140, 145 and at least one slidable weight 150 having a pair of parallel grooves 152, 154 that receive the parallel rails 140, 145, and is disposed within a shallow channel 160 in the sole 20. The parallel rails 140, 145 protrude from a floor 162 of the channel 60, which also has a plurality of side walls 164, 166 extending away from the floor 162. The slidable weight 150 preferably has a mass of 1 to 10 grams, including a mass of 2.5 grams if two slidable weights 150 are used and 7 grams if only one slidable weight 150 is used. As shown in FIGS. 4 and 5, the slidable weight assembly includes two slidable weights 150, each of which is affixed to an exterior portion of the parallel rails 140, 145 and is movable in a face 16 to rear 90 direction, e.g., along the X-axis. In other embodiments, the parallel rails 140, 145 may extend in a heel 12 to toe 14 (Y-axis) direction, may curve along a periphery of the golf club head 10 body, or may extend diagonally across the body of the golf club head 10.

As shown in FIG. 6, each slidable weight 150 preferably is affixed to the parallel rails 140, 145 with a screw 170, which, when tightened, presses against the sole 20, pushes the weight 150 away from the sole 20, presses the rails 140, 145 against the lower surfaces of the grooves 152, 154, thus removably fixing the weight 150 in place on the rails 140, 145. In an alternative embodiment, the slidable weights 150 may be loosened or tightened as disclosed in FIGS. 11, 12A, and 12B of U.S. Provisional Patent Application No. 61/893,728, the disclosure of which is hereby incorporated by reference in its entirety herein. In other embodiments, the slidable weight assembly 130 may have any of the configurations disclosed in U.S. patent application Ser. No. 14/033,218, the disclosure of which is also hereby incorporated by reference in its entirety herein. This golf club head 10, which allows for the adjustment of bias, CG depth, and CG height, may have the characteristics shown in Table 3 below.

TABLE 3

| Current | Estimate | CG Delta | | |
|---|---|---|---|---|
| Mass (g) | Mass (g) | Depth | Bias | Height |
| 205 | 199.5 | 0.081 | 0.102 | 0.090 |

Each of the embodiments disclosed herein are described and shown in combination with a driver-type golf club head, but may also be used with other wood-type golf club heads (e.g., fairway woods), irons, hybrids, and putters, which may have any material composition known to a person skilled in the art. They allow a user to adjust the location of the center of gravity along vertical z- and horizontal x- and y-axes, and can disposed anywhere on the body. For example, instead of being located on the sole 20, the weight ports 30, 40, 50 may be located on the crown 25, face, or in a skirt or ribbon portion (if one exists).

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:
a metal face component;
a body comprising a composite crown, a metal sole, a heel side, a toe side, and a rear side;
at least one center of gravity adjustment assembly comprising:
a tube extending through an interior cavity of the golf club head, and
a cylindrical weight cartridge sized to fit within the tube, wherein the cartridge comprises a polymer material and a slug having a specific gravity that is greater than the specific gravity of the polymer material, a length L, and a mass $M_T$;
at least one weight port disposed in the sole;
a channel disposed in the sole and extending perpendicular to the face component, the channel comprising a floor, a plurality of walls extending away from the floor, and a pair of parallel rails protruding from the floor; and
at least one slidable weight comprising a pair of grooves sized to receive the pair of parallel rails,
wherein the at least one center of gravity adjustment assembly is disposed within the body and extends from the sole to the crown,
wherein changing the orientation of the cartridge within the tube changes the location of the golf club head's center of gravity along a vertical Z axis,
wherein the golf club head has a mass M,
wherein the distance from the midpoint of the length L to a center of gravity of the cartridge when the cartridge is disposed within the tube such that the slug is closer to the sole is defined as ½D,
wherein the golf club head satisfies the equation $D \geq 0.065(1+M/M_T)$, and
wherein D is the total center of gravity distance change for the cartridge when its orientation is changed within the tube by being flipped.

2. The golf club head of claim 1, wherein the golf club head has a mass of 200 to 210 grams.

3. The golf club head of claim 1, wherein the golf club head comprises an adjustable hosel.

4. The golf club head of claim 1, wherein the at least one center of gravity adjustment assembly or the slidable weight assembly adjusts a bias of the golf club head by at least 0.100 inch.

5. The golf club head of claim 1, wherein the slidable weight assembly adjusts a center of gravity depth by at least 0.080 inch and a center of gravity height by at least 0.090 inch.

6. The golf club head of claim 1, wherein the at least one slidable weight comprises a mass of 2 to 10 grams.

7. The golf club head of claim 1, wherein the golf club head is selected from the group consisting of a wood-type head, an iron-type head, a hybrid-type head, and a putter-type head.

8. The golf club head of claim 7, wherein the golf club head is a wood-type head.

* * * * *